United States Patent [19]

Hayashi et al.

[11] Patent Number: 4,614,172

[45] Date of Patent: Sep. 30, 1986

[54] CYLINDER HEAD FOR INTERNAL COMBUSTION ENGINE

[75] Inventors: Tadayoshi Hayashi, Fujimi; Hideaki Ushio, Turugashima, both of Japan

[73] Assignee: Honda Giken Kogyo Kabushiki Kaisha, Tokyo, Japan

[21] Appl. No.: 727,990

[22] Filed: Apr. 29, 1985

[30] Foreign Application Priority Data

May 28, 1984 [JP] Japan ..... 59-78132[U]

[51] Int. Cl.[4] ..... F01L 3/02

[52] U.S. Cl. ..... 123/188 S; 123/193 H; 29/156.7 A

[58] Field of Search ..... 123/188 S, 193 H; 29/156.7 A

[56] References Cited

U.S. PATENT DOCUMENTS 4,216,682 8/1980 Ban et al. ..... 74/579 E
4,530,322 7/1985 Yamada et al. ..... 123/188 S

FOREIGN PATENT DOCUMENTS 2484042 12/1981 France .

*Primary Examiner*—Ira S. Lazarus
*Attorney, Agent, or Firm*—Armstrong, Nikaido, Marmelstein & Kubovcik

[57] ABSTRACT

The present invention is directed to a cylinder head for an internal combustion engine, the cylinder head having a valve seat formed therein. The valve seat comprises a plurality of reinforcing fibers cast in a metal matrix. The metal matrix is integrally formed with the valve body by being cast with the remaining portion valve body. The valve seat and valve body are cast from the same material.

5 Claims, 2 Drawing Figures

CYLINDER HEAD FOR INTERNAL COMBUSTION ENGINE

BACKGROUND OF THE INVENTION

1. Field of the Invention

The present device relates to a cylinder head for an internal combustion engine and, more particularly, to an improvement in the cylinder head having its body formed with a valve seat onto which an on-off valve is to be seated.

2. Description of the Prior Art

In the prior art method of forming a cylinder head body with a valve seat, an annular element made of a different material such as a sintered material is press-fitted in the cylinder head body or cast in the cylinder head body when the latter is cast.

In the prior art press-fitting method, however, the annular element which is made of a different material, has to be held by the cylinder head body. As a result, the holding portion becomes thick and deteriorates the coolability around the valve seat, which can cause knocking and a drop in the combustion efficiency.

In the prior art casting method, on the other hand, the adhesion between the annular member of the different material and the cylinder head body is poor and is degraded by the difference between the coefficients of thermal expansion. Thus, an interface is established between the body and annular member to cause problems similar to the problems discussed above.

SUMMARY OF THE INVENTION

The present invention is directed to a cylinder head for an internal combustion engine, the cylinder head having a valve seat formed therein. The valve seat comprises a plurality of reinforcing fibers cast in a metal matrix. The metal matrix is integrally formed with the valve body by being cast with the remaining portion valve body. The valve seat and valve body are cast from the same material.

The valve seat of the present invention has a sufficient strength because it is reinforced by the reinforcing fibers, and has an excellent coolability because its surrounding portion need not be made thick. Since the matrix of the valve seat and the cylinder head body are made of a common material, no interface is established between the valve seat and the cylinder head body.

DETAILED DESCRIPTION OF THE PREFERRED EMBODIMENTS

Figure 1:
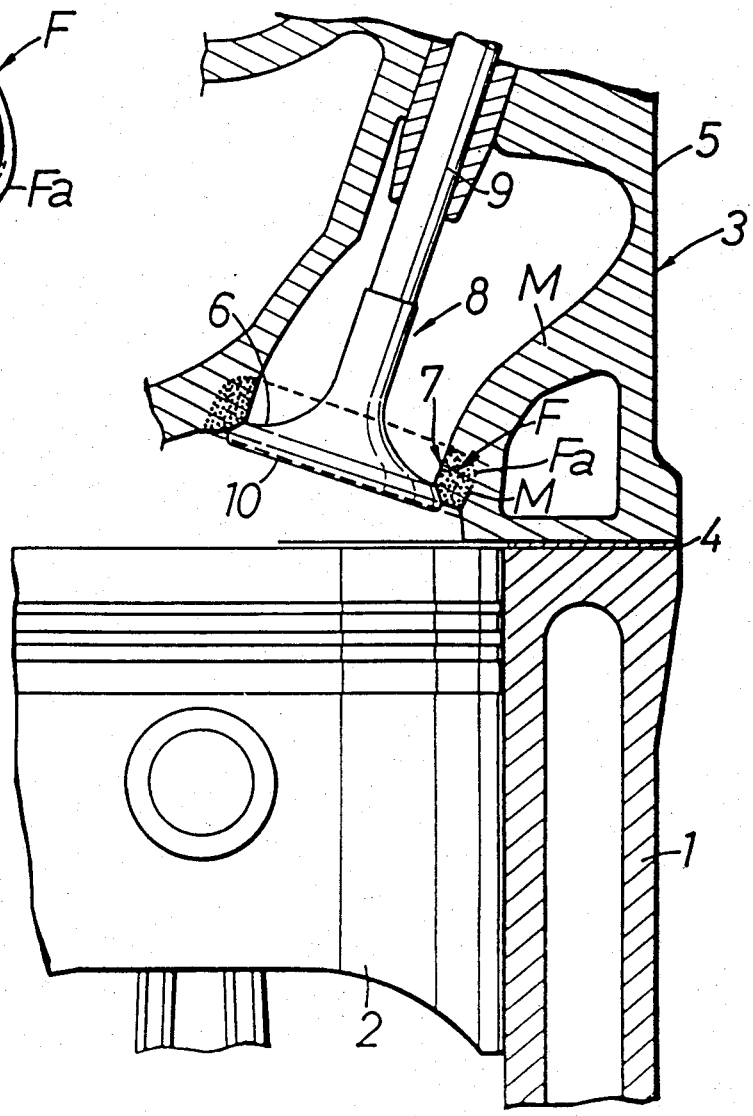
FIG. 1 is a longitudinal, sectional, front elevation view showing a portion of the internal combusion engine having a valve seat of the present invention.

FIG. 1 shows a portion of an internal combustion engine. A piston 2 is slidably fitted in a cylinder block 1, and a cylinder head 3 is mounted on the upper end face of the cylinder block 1 with a gasket 4 therebetween.

The cylinder head 3 has a cast body 5 which is formed with an annular valve seat 7 at the valve port 6. Stem 9 of valve 8 is slidably fitted in the head body 5. The valve 8 acts as an intake or exhaust valve wherein a valve head 10, integrally formed with the valve stem 9, can be seated on the valve seat 7.

The cylinder head body 5 is made of an aluminum alloy such as the alloy AC2B according to Japanese Industrial Standards, and the valve seat 7 is constructed of reinforcing fibers F and a matrix M made of the same aluminum alloy as the cylinder head body 5. The reinforcing fibers F comprise a mixture of fibers including ceramic fibers having a high refractory strength such as alumina fibers or silicon carbide, and glass, metal or carbon fibers having a low coefficient of friction.

Figure 2:
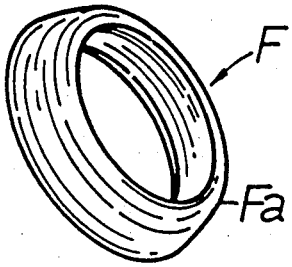
FIG. 2 is a perspective view showing the reinforcing fibers of the present invention.

The reinforcing fibers F comprise the aforementioned mixed fibers and are shaped into an annular piece, as shown in FIG. 2, and the face which mates with the cylinder head body 5 is curved into a projecting face Fa. If the mating face of the reinforcing fibers F are shaped into the projecting face Fa, the mating side of the cylinder head body 5 is formed into a recessed face to eliminate the concentration of stress wherein the cylinder head body 5 is prevented from cracking.

The valve seat 7 is formed simultaneously with the casting of the cylinder head body 5. Specifically, the valve seat 7 is prepared by fixing the aforementioned reinforcing fibers F in the portion of a mold, for casting the cylinder head body 5, to form the valve seat 7, by pouring the molten metal of the aforementioned aluminum alloy into the mold, and by subsequently applying a predetermined pressure to the molten metal to impregnate the reinforcing fibers F with a portion thereof to form a matrix.

The reinforcing fibers F may be composed of only one kind of the aforementioned several fibers, e.g., only carbon fibers having both the refractory strength and low coefficient of friction required.

According to the present device, the valve seat has sufficient strength at high temperatures because it is reinforced by the reinforcing fibers. Since the valve seat need not have its surrounding portion thickened, the coolability is improved, and the weight is reduced. Still further, no interface is formed between the valve seat and the cylinder head body because the matrix of the valve seat and the cylinder head body are made of the identical material. As a result, it is possible to solve the prior art problems such as knocking and the reduction in the combustion efficiency.

The present invention may be embodied in other specific forms without departing from the spirit or essential characteristics thereof. The presently disclosed embodiment is, therefore, to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A cylinder head for an internal combustion engine, said cylinder head having a body with a valve seat formed therein, said valve seat comprising a plurality of reinforcing fibers cast in a metal matrix, said metal matrix being integrally formed with said body and consisting of the same material as said body.

2. A cylinder head as set forth in claim 1, wherein said reinforcing fibers comprise ceramic fibers which have a high refractory strength and glass fibers having a low coefficient of friction.

3. A cylinder head as set forth in claim 1, wherein said reinforcing fibers comprise ceramic fibers having a high refractory strength and carbon fibers having a low coefficient of friction.

4. A cylinder head as set forth in claim 1, wherein said reinforcing fibers comprise ceramic fibers having a high refractory strength and metal fibers having a low coefficient of friction.

5. A cylinder head as set forth in any one of claims 1–4, wherein said reinforcing fibers are curved along the face where said valve seat mates with said cylinder head body.

* * * * *